US007878212B2

(12) United States Patent
Ubertifoppa

(10) Patent No.: US 7,878,212 B2
(45) Date of Patent: Feb. 1, 2011

(54) SUPPORTING PLATE FOR COSMETIC PRODUCTS

(75) Inventor: Angelo Ubertifoppa, Crema (IT)

(73) Assignee: Modapack S.r.l., Offanengo (IT)

( * ) Notice: Subject to any disclaimer, the term of this patent is extended or adjusted under 35 U.S.C. 154(b) by 616 days.

(21) Appl. No.: 11/914,803

(22) PCT Filed: May 1, 2006

(86) PCT No.: PCT/IB2006/001138

§ 371 (c)(1),
(2), (4) Date: Dec. 7, 2007

(87) PCT Pub. No.: WO2006/123209

PCT Pub. Date: Nov. 23, 2006

(65) Prior Publication Data

US 2008/0190443 A1 Aug. 14, 2008

(30) Foreign Application Priority Data

May 17, 2005 (IT) ..... CR2005A0007

(51) Int. Cl.
*A45D 33/00* (2006.01)
*A45D 33/24* (2006.01)
*A45D 33/26* (2006.01)

(52) U.S. Cl. ..... 132/294; 132/293; 132/303

(58) Field of Classification Search ..... 132/293–298, 132/303, 305; 206/581, 823
See application file for complete search history.

(56) References Cited

U.S. PATENT DOCUMENTS

| | | | | | |
|---|---|---|---|---|---|
| 1,236,844 | A | * | 8/1917 | Kendall | 132/303 |
| 1,506,017 | A | | 8/1924 | Lusher | |
| 1,602,981 | A | * | 10/1926 | Kendall | 132/293 |
| 1,714,376 | A | * | 5/1929 | Kendall | 132/303 |
| 1,743,611 | A | * | 1/1930 | Larson | 132/294 |
| 1,836,832 | A | * | 12/1931 | Ames | 132/293 |
| 2,089,833 | A | * | 8/1937 | Kasdan | 132/303 |
| 2,806,312 | A | * | 9/1957 | Grumbacher | 206/1.7 |
| 3,698,594 | A | * | 10/1972 | Boehlert | 220/495.01 |

FOREIGN PATENT DOCUMENTS

| | | |
|---|---|---|
| FR | 2 767 038 A | 2/1999 |
| WO | 96/19131 A | 6/1996 |
| WO | 01/26501 A1 | 4/2001 |

* cited by examiner

*Primary Examiner*—Robyn Doan
(74) *Attorney, Agent, or Firm*—Young & Thompson

(57) ABSTRACT

A supporting plate for a cosmetic product (P), includes a hollow region (C) for receiving the cosmetic product, and a retaining part (22; 44; 67; 105; 206, 207) which is protruding from the sidewall of the hollow region (C), for retaining the cosmetic product and avoiding its detachment from the plate. Examples refer to embodiments wherein the supporting plate is made by two or more elements joined together, or molded in a single piece. The main advantageous effect is that glue is no longer required to fix the cosmetic product on the supporting plate.

13 Claims, 5 Drawing Sheets

Figure 1:
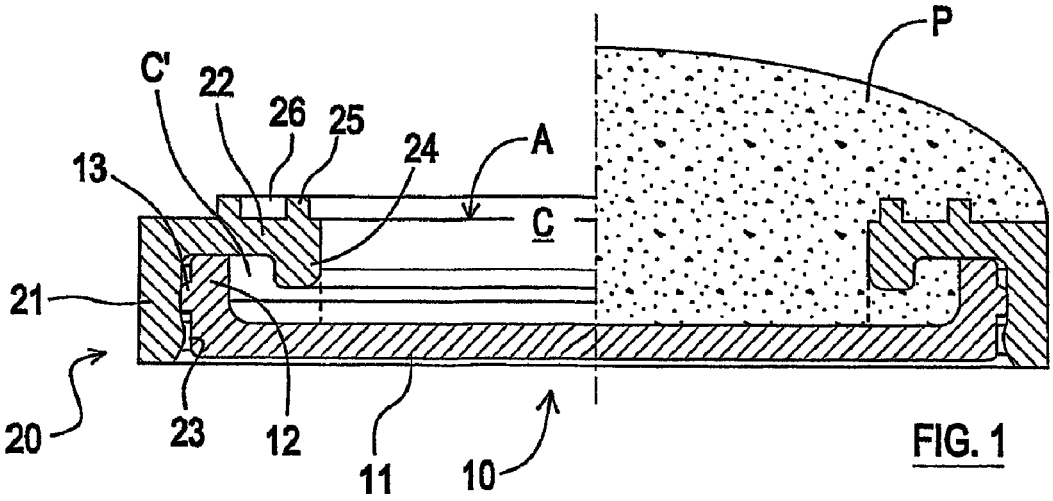

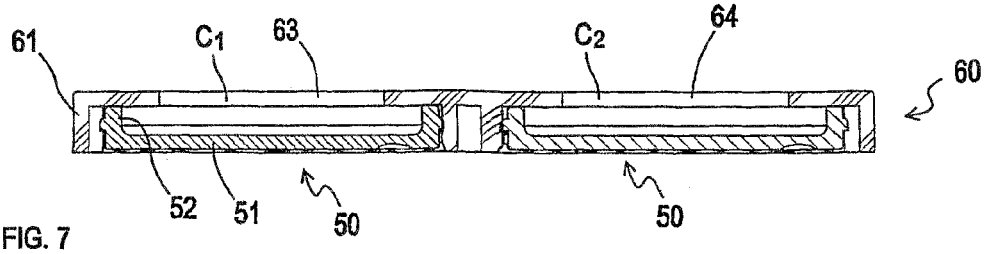
FIG. 7
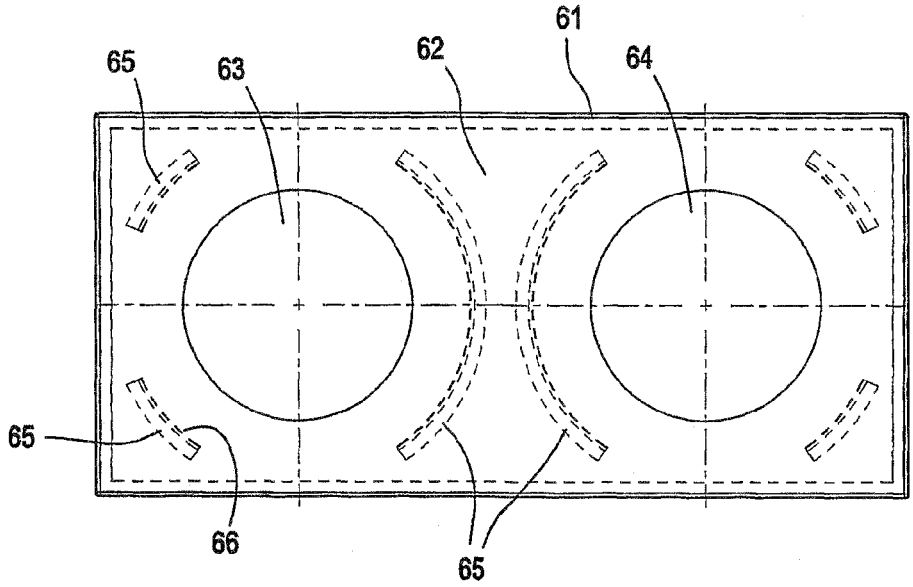
FIG. 8
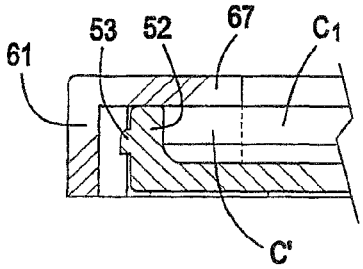
FIG. 9a
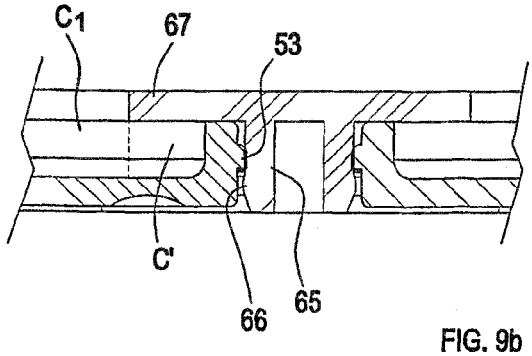
FIG. 9b
FIG. 10
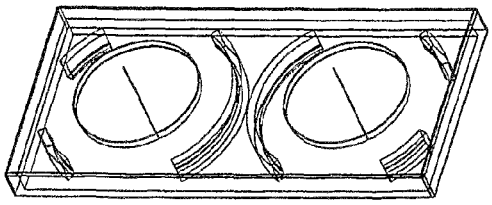

SUPPORTING PLATE FOR COSMETIC PRODUCTS

The invention relates to the field of cosmetics; more in detail the invention relates to small plates used as supports for cosmetic products like a powder, an extruded paste or an emulsion.

The cosmetic industry makes use of small plates made of plastics or terra-cotta, as supports for various products like face powder, eye-shadow, etc. . . . These supporting plates have generally the form of a small disk with a substantially planar top face, where the cosmetic product is applied. Other forms are also used, e.g. square, rectangle, diamond, and so on.

A technical problem posed by these supporting plates is the anchorage of the cosmetic product on the plate.

According to known technique, this is accomplished by impregnating the small plates with a vinyl glue, which is activated when the humid product is dosed and pressed on the plate; the plates with the cosmetic product are then dried in a suitable oven.

The design of the plate is also known to influence the fixing of the product; for this reason some supporting plates are realized with grooves or indentations on the top face, in order to increase the available gripping surface. A prior-art type of plastic supporting plate, for example, has a slightly recessed top face, with a number of pyramid-like reliefs. Notwithstanding these known solutions, however, the glue is still considered indispensable to provide a suitable fixing action.

The glue has some drawbacks from the hygienic point of view, manly because of its content in highly volatile components which may contaminate the cosmetic product, especially during the oven drying. Overall cost of the plates is also increased by the process step of applying the glue.

Further to this, the result is not yet satisfactory, as the cosmetics are still affected by detachment of the product, e.g. due to shocks or drops. The fixing is checked with a test called "drop test", wherein the cosmetic is dropped on a rigid surface from a height of 30 cm. Said test, which requires that no detachment occurs after at least three drops, is not always passed with the above described known solutions.

The small plates made of terra-cotta, even more used than plastic ones, show further disadvantages due to nature of the material: fragility, rough dimensional tolerances, the fact that the supporting plate cannot be realized with custom colour or finishing.

The main purpose of the invention is to overcome these problems still affecting the prior art, realizing a supporting plate adapted to efficiently retain the cosmetic product, without glue. A further purpose is to realize a plate with constant shape and dimensions, low cost, light and easy to personalize with special colours or finishing.

The aims are reached with a supporting plate for a cosmetic product, characterized by a body comprising:

a bottom part;

sidewalls surrounding said bottom part;

wherein said bottom part and sidewalls define at least one hollow region for receiving said cosmetic product, said body further comprising a retaining part which is protruding from sidewalls of the hollow region to cover a portion of said bottom part, for acting as retaining means for the cosmetic product contained therein and defining a gripping portion into said hollow region.

Said retaining part may be in the form of a continuous part, namely a collar or rib protruding from the sidewalls of the hollow region over the underlying bottom plate, or in the form of a plurality of discrete protruding parts such as tongues or teeth.

According to one embodiment, the supporting plate is made with a plurality of elements joined together, preferably a frame element and one or more bottom plates joined to said frame element. The frame element forms the sidewalls of the hollow region, while the bottom plate forms its bottom.

The frame element and bottom plate(s) cooperate, when joined, to define the aforesaid hollow region for the cosmetic product. In some embodiments, the supporting plate may comprise a plurality of hollow regions for different cosmetic products, or for the same product with different colours.

According to one embodiment, the frame element has a substantially L-shaped cross section, forming a collar over the underlying bottom plate. According to another embodiment, the frame element forms sidewalls with a plurality of tongues which extend over the bottom part.

According to another embodiment, the supporting plate is made (e.g. molded) in a single piece, with a bottom surface and a lateral wall surface delimiting a hollow region to receive the cosmetic product, and said lateral wall surface comprises a protruding rib which acts as a retaining means for the cosmetic product, forming a narrow gripping region near the wall itself.

It is to be noted that the above described retaining parts correspond to undercut parts of the supporting plate, so that their size is limited for technical reason when the plate is molded in a single piece. The size of said retaining parts in a single-piece embodiment can be increased if the support is made by blowing a soft plastic material; this may however cause some problems of softening at the oven temperatures, so that the molded-ABS solution is generally preferred.

According to further aspects of the invention, the supporting plate has a central portion which is raised with respect to the bottom of the hollow region containing the cosmetic product, to reduce the volume of the hollow region itself that normally corresponds to unused product.

Means such as, for example, radial teeth extending from the center of the hollow region and towards its lateral wall, are also advantageously provided to prevent the compacted product from rotating on the supporting plate.

The main advantage of the invention is that glue is no longer required to fix the cosmetic product on the supporting plate. In practical terms, the chemical retaining action of the glue is replaced by a mechanical retaining action provided by the above described retaining parts. The realization with molded plastics ensures the further advantages of good tolerances, low cost and weight, support realizable with any colour or shape.

Figure 2:
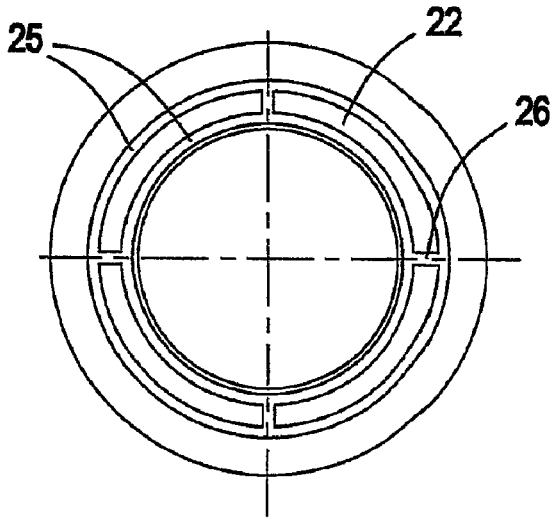
Figure 3:
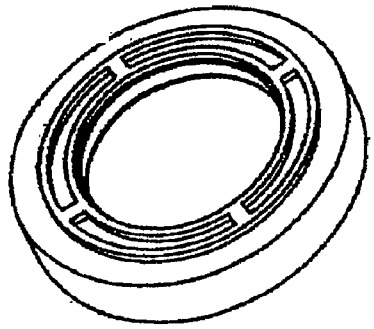
Figure 4:
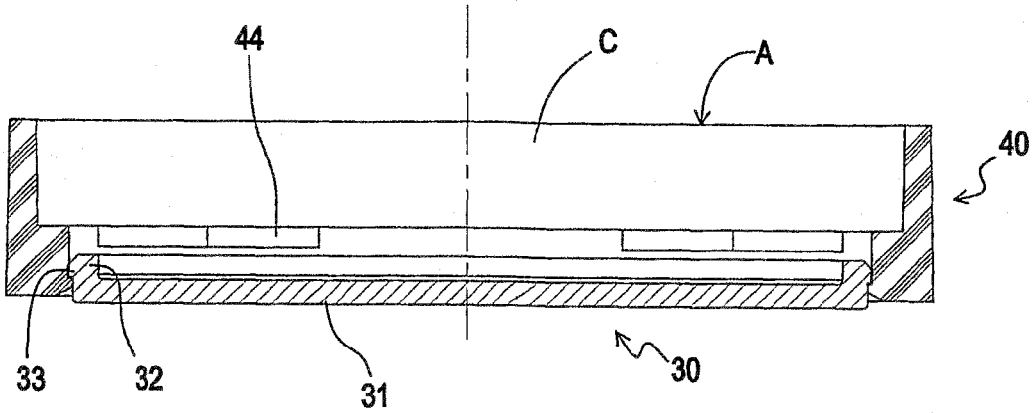
Figure 5:
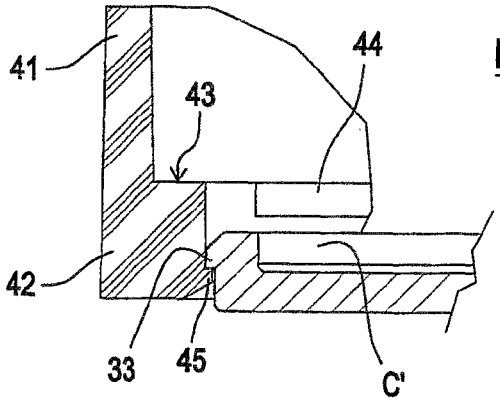
Figure 6:
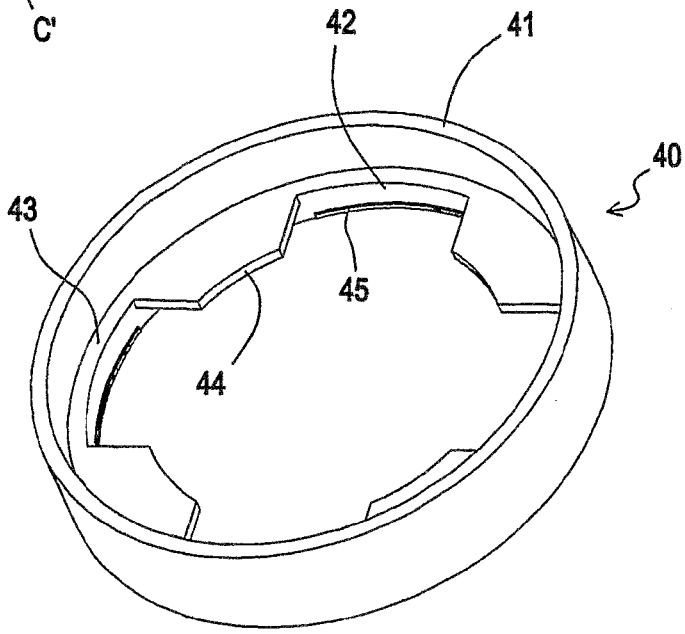
Figure 11:
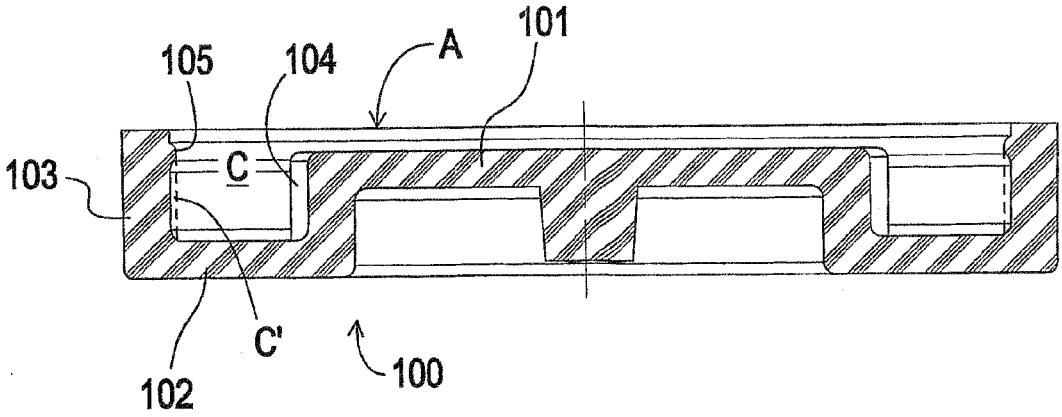
Figure 12:
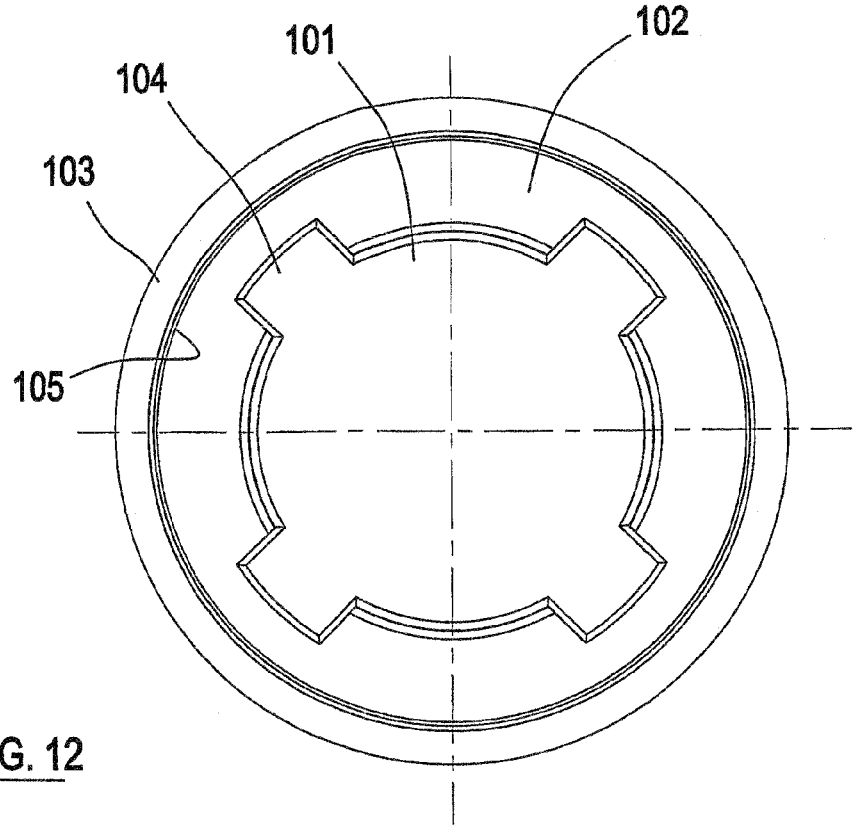
Figure 13:
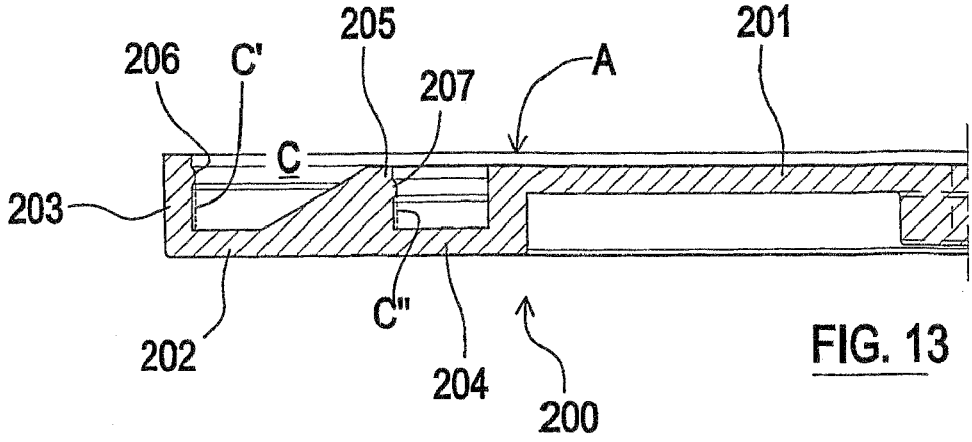
Figure 14:
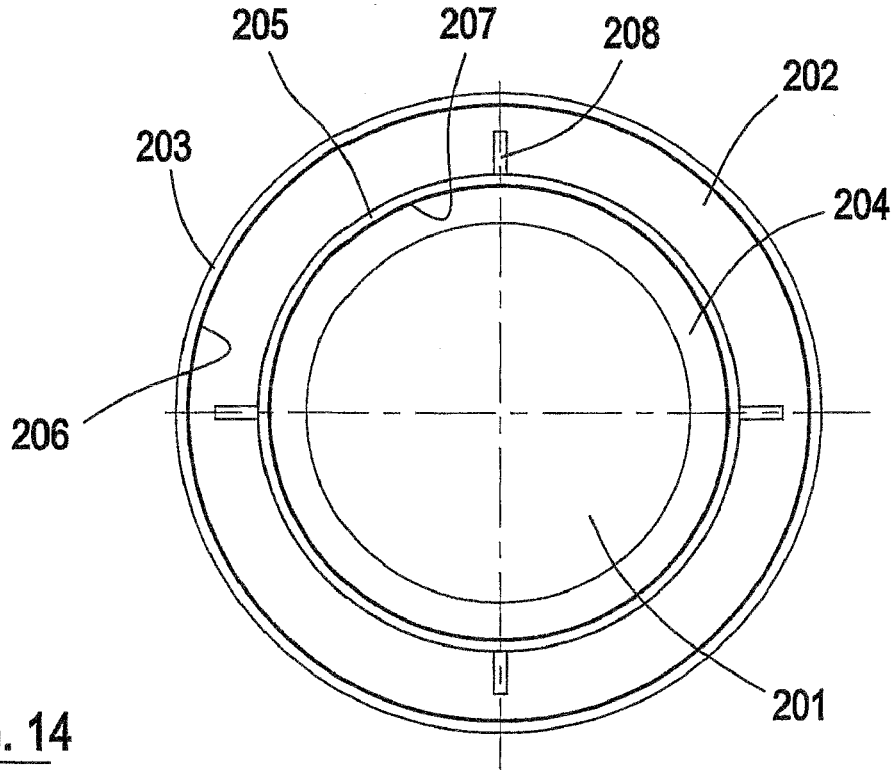

The features and advantages of the invention will be more evident with the help of the following detailed description of some preferred embodiments and with the help of the drawings, wherein:

FIG. 1 is a cutaway view of a supporting plate for cosmetic products (partially filled) according to one embodiment of the invention, FIGS. 2 and 3 are a top view and a perspective view of the plate of FIG. 1, FIG. 4 is a cutaway view of a disk-shaped support according to another embodiment of the invention, FIG. 5 is a detail of FIG. 4, FIG. 6 is a perspective view of one element of the supporting plate of FIG. 4, FIG. 7 is a cutaway view of a rectangular supporting plate according to a further embodiment of the invention, FIG. 8 is a top view of the supporting plate of FIG. 7, FIGS. 9*a* and 9*b* are detail of FIG. 7, FIG. 10 is a transparent view of the rectangular supporting plate of FIG. 7, FIG. 11 is a cross sectional view of still another embodiment, wherein the supporting plate is made by a single piece, FIG. 12 is a top view of the embodiment of FIG. 11, FIGS. 13 and 14 are a cross sectional view and top view of another version of a single-piece supporting plate.

Referring now to the figures, the invention relates to a supporting plate for a cosmetic product like a powder, extruded paste or emulsion. Typically, such products are in the form of a powder which is pressed on the support and then dried in a suitable oven.

Basically, the figures refer to two embodiments, i.e. an embodiment wherein the supporting plate comprises a frame element and one or more bottom plates joined to said frame element (FIGS. 1 to 10), and another embodiment wherein the supporting plate is realized in a single piece (FIGS. 11 to 14).

Referring now to the first embodiment of FIGS. 1 to 3, the supporting plate is made of a bottom plate or disc 10 joined to a substantially annular frame or ring 20.

The disc 10 and ring 20 form a supporting plate with an open top face A and a hollow region C, for receiving a cosmetic product P like a powder, extruded paste or emulsion. The product P is generally pressed to fill said hollow region C and form a sort of dome over the plate, as shown in the right half of FIG. 1.

The disc 10 has a substantially U-shaped cross section, with a planar central portion 11 surrounded by a rim 12. Said rim 12 has an external, small tooth 13 for the connection with ring 20.

The ring 20 has a substantially L-shaped cross section, forming a collar 22 over the disc 10. More in detail, the ring 20 comprises a first portion 21, forming the external sidewall of the plate, and a second portion forming the collar 22, so that a peripheral portion of disc 10 is covered by said collar 22 (FIG. 1).

The portion 21 of ring 20 comprises an internal small tooth 23, which is adapted to be engaged by the corresponding tooth 13 of disc 10, so that the disc 10 can be joined to ring 20.

The collar 22 acts as a mechanical retaining means for the cosmetic product P pressed into the hollow region C. As seen in FIG. 1, the collar 22 defines an annular gripping portion C' of the hollow region C, shown by dotted line of FIG. 1 and comprised between the collar 22 itself and the disc 10.

To achieve a better anchorage of the product, the collar 22 is preferably shaped to form a rib 24, extended towards the disc 10.

The annular top face of the collar 22 is preferably provided with at least one further rib 25; in the shown embodiment there are two concentric ribs 25 (FIG. 2). Said ribs 25 may also be connected by radial teeth 26, for the purpose of increasing the gripping surface and prevent the product P from rotating on the support.

The second embodiment of FIGS. 4 to 6 is quite similar, showing a supporting plate made of a bottom disc 30 and a ring 40, defining a hollow region C with an open top face A.

The disc 30 has a substantially U-shaped cross section, with a planar central portion 31 surrounded by a rim 32. Said rim 32 has an external, small tooth 33 for the connection to ring 40.

The ring 40 comprises an upper portion 41 and a lower, thicker portion 42, defining an annular plane surface 43. A plurality of tongues 44 are extending from the upper end of said lower portion 42, that is from the annular plane surface 43. Further small teeth 45 are provided near the opposite, lower end of lower portion 42. Tongues 44 and small teeth 45 are best seen in FIG. 6, showing the ring 40 without bottom disc 30.

Said small teeth 45 act as engaging means for the bottom plate 30, in cooperation with said small tooth 33 provided on rim 32 of the latter (see detail of FIG. 5).

When the bottom plate 30 and ring 40 are joined together, the tongues 44 extend over peripheral sectors of said bottom disc 30, and act as a retaining means for the cosmetic product contained in hollow region C. It can be appreciated (see again FIG. 5) that gripping portions C' of hollow region C are formed between the tongues 44 and the underlying bottom disc 30.

A useful feature of this embodiment of FIGS. 4 to 6 is that it can be filled or re-filled with cosmetic product both from the top or the bottom. The cosmetic, after filling, can then be sealed with a plastic film.

Referring now to FIGS. 7 to 10, another realization is shown, wherein the supporting plate is made with two bottom discs 50 joined to a rectangular frame 60. The resulting supporting plate comprises two hollow regions C1 and C2, to receive two (e.g. different coloured) cosmetic products.

Bottom discs 50 have a U-shaped cross section with a central portion 51 and a rim 52, with a small tooth or protrusion 53 for the fixing to the frame 60.

Said rectangular frame 60 forms a lateral, external wall 61 and a top face 62 provided with two holes 63 and 64 over the two hollow regions C1 and C2.

Arc-shaped walls 65 are arranged on the internal side of top face 62, around the holes 63, 64. Said walls 65 comprise a small tooth 66, facing the respective hole 63 or 64, adapted to be engaged by said small tooth 53 of bottom discs 50.

Looking at FIGS. 9*a* and 9*b*, it can be appreciated that gripping portions C' are formed into the hollow regions C1 and C2, lying around the holes 63 and 64. More in detail, a portion 67 of top face 62, around holes 63 and 64 and protruding from wall parts 61 and 65, acts as a retaining means for the cosmetic product, covering a portion of the respective, underlying bottom disc 50.

It can also be noted that gripping regions C' (see dotted lines of FIGS. 9*a* and 9*b*) are in an "undercut" position relative to said portion 67 of top surface 62.

The whole supporting plate is best seen in the perspective transparent view of FIG. 10.

It is clear to the skilled person that the frame 60 may have other geometrical shapes, e.g. round, square, diamond and so on, and that more than two holes and corresponding hollow regions may be provided.

Turning now to FIGS. 11 and 12, the support is made by a single body 100 which substantially comprises a central portion 101, an annular bottom portion 102 and a lateral wall 103 surrounding said annular bottom portion 102. The central portion 101 (see FIG. 12) has radial extensions 104 extending towards the lateral wall 103.

The body 100 has an open top face A and defines a hollow region C, for containing the cosmetic product, which comprises the annular volume over the annular portion 102 and the volume between the top surface of the portion 101 and the plane of the face A.

The internal surface of the wall 103 has a slightly protruding rib 105 which extends from wall 103 and towards the central portion 101, thus covering a portion of underlying bottom 102.

Said rib 105 acts as a retaining means for the product contained in the hollow region C, defining a gripping portion C' into said hollow region C. Gripping portion C' corresponds to a narrow, annular region leaning near the sidewall 103, as shown by the dotted line of FIG. 11.

As the body 100 is molded in a single piece, the size of the protruding rib 105 is limited for technical reason, otherwise the piece cannot be extracted from the mould; as an example, in a 020 mm plate the rib 105 may extend for about 0.15 mm from internal face of the sidewall 103. This is sufficient, however, to achieve the desired gripping action on the cosmetic product.

The portion 101 is raised over the plane of annular portion 102, as seen the figures, to reduce the volume of the hollow region C. Most consumers, in fact, are used to throw the cosmetic out when the product reaches the plane of face A, i.e. to make use only of the product which forms the dome over the support. It is then convenient to reduce the volume of cavity C, corresponding to unused product.

Radial extensions 104 have the purpose of giving a better grip and avoid rotation of the product on the support.

FIGS. 13 and 14 show a further embodiment made in a single piece, particularly for medium and large supporting plates, for example disks having a diameter of 60 mm and over.

The support is made with a body 200, comprising a central portion 201, an annular bottom portion 202, surrounded by an external wall 203, and a further annular bottom portion 204 defined by an intermediate wall 205. The body 200 defines a hollow region C, to contain the cosmetic product.

External wall 203 has a protruding rib 206, which covers a part of bottom portion 202, and intermediate wall 205 has a protruding rib 207, covering a part of bottom portion 204. A first annular gripping portion C' and a second, concentric gripping portion C", are thus formed in the hollow region C.

The central portion 201 is raised to reduce the volume of the hollow region C, corresponding to unused product; the intermediate wall 205 also forms radial extensions 208, disposed to avoid rotation of the product on the support. Said extensions 208 have a substantially triangular cross section, with a vertical face towards the center of the support, and an inclined face towards the external wall 203.

It is clear to the skilled person than all the above embodiments may be varied according to the invention. In particular, the supporting plate can equally be realized with any suitable geometrical or fancy shape, such as a rectangle, a square, a diamond, and so on. Dimensions may obviously vary according to the needs; diameter of disk-shaped supports is typically 20 to 200 mm.

It is also clear to the skilled person that the invention may be realized in further embodiments, equivalent to the above described ones. For example, a further, simplified embodiment of the invention (not shown) can be obtained with body in a single piece, having a plane bottom without the central raised portion and surrounded by a sidewall portion, i.e. a piece substantially having a "U" cross-section.

It is noted that a suitable central raised portion can be provided for all embodiments, including e.g. the embodiment of FIGS. 1-6 where the central portion of the plate 10 or 30 can be raised to reduce the volume of hollow region C.

The preferred material is a plastic material, for its properties of stability, constant dimensions, lightness and low cost; more preferably the support is molded in ABS.

The support according to the invention reaches the aforementioned purposes; in particular it retains the product without requiring glue, is light and cheap, can be realized with precise tolerances and with custom colour or finishing.

The invention claimed is:

1. A supporting plate for a cosmetic product (P), characterized by a body comprising:

a bottom part (11; 31; 51; 102; 202, 204);

sidewalls (21; 41, 42; 61, 65; 103; 203, 205) surrounding said bottom part;

wherein said bottom part and sidewalls define at least one hollow region (C; C1, C2) for receiving said cosmetic product, said body further comprising a retaining part (22; 44; 67; 105; 206, 207) which is protruding from sidewalls of the hollow region to cover a portion of said bottom part, for acting as retaining means for the cosmetic product contained therein and defining a gripping portion into said hollow region, wherein the body comprises a frame element (20; 40; 60) and at least one bottom plate (10; 30; 50) joined to said frame element, the frame element define said sidewalls of the hollow region and retaining part, and the bottom plate define said bottom part of the hollow region, wherein said frame element (20; 60) has a substantially L-shaped cross section, forming a collar (22; 67) over a peripheral portion of bottom plate (10; 50), and wherein the collar (22) has a top surface provided with at least one protruding rib (25) to increase the gripping effect and prevent the product from rotating on the plate, in cooperation with radial teeth (26).

2. A plate according to claim 1, wherein said retaining part is a continuous collar (22; 67) or rib (105; 206, 207) protruding from sidewalls of the hollow region.

3. A plate according to claim 1, wherein said retaining part is formed by a plurality of tongues (44) disposed to cover portions of said bottom part.

4. A plate according to claim 1, wherein the collar (22) is shaped to form an internal rib (24) extending towards the bottom plate (10), to achieve a better fixation of the cosmetic product.

5. A plate according to claim 1, wherein the frame element (40) define a sidewall with an upper portion (41) and a lower, thicker portion (42); a plurality of tongues (44) are extending from the upper end of said lower portion (42), acting as retaining means for the cosmetic product; engaging means (45) for the bottom plate (30) are provided near the opposite, lower end of lower portion (42).

6. A supporting plate according to claim 1, wherein the frame element is a substantially annular element or ring, and the bottom plate is a disc.

7. A supporting plate according to claim 1, wherein said frame element comprises a tooth element (23; 45; 66) adapted to be engaged by a corresponding tooth (13; 33; 53) of said bottom plate.

8. A supporting plate according to claim 1, wherein the body comprises a frame (60) and a plurality of bottom plates (50); said frame (60) has a lateral, external wall (61) and a top face (62) provided with one hole (63, 64) for each of said bottom plates (50), so that a plurality of hollow regions for receiving cosmetic products are defined into the supporting plate.

9. A plate according to claim 1, wherein the body is made by a single piece (100; 200) comprising a bottom portion (102; 202, 204) surrounded by a sidewall portion (103; 203, 205), and said sidewall portion comprises a protrusion (105; 206, 207) which extend to cover a portion of the underlying bottom portion and defines a gripping region (C) near the surface of the sidewall portion.

10. A plate according to claim 9, wherein the body comprises a central portion (201), an external sidewall portion (203) with a first protrusion (206) and an intermediate sidewall portion (205) with a second protrusion (207), delimiting a first gripping region (C) and a second gripping region (C").

11. A plate according to claim 1, characterized in that it is made of a plastic material.

12. A plate according to claim 1 further comprising a cosmetic product, especially in the form of a powder, extruded paste or emulsion.

13. A supporting plate for a cosmetic product (P), characterized by a body comprising:

a bottom part (11; 31; 51; 102; 202, 204);

sidewalls (21; 41, 42; 61, 65; 103; 203, 205) surrounding said bottom part;

wherein said bottom part and sidewalls define at least one hollow region (C; C1, C2) for receiving said cosmetic product, said body further comprising a retaining part (22; 44; 67; 105; 206, 207) which is protruding from sidewalls of the hollow region to cover a portion of said bottom part, for acting as retaining means for the cosmetic product contained therein and defining a gripping portion into said hollow region, wherein the body comprises a frame element (20; 40; 60) and at least one bottom plate (10; 30; 50) joined to said frame element, the frame element define said sidewalls of the hollow region and retaining part, and the bottom plate define said bottom part of the hollow region wherein the body comprises a frame (60) and a plurality of bottom plates (50), said frame (60) has a lateral, external wall (61) and a top face (62) provided with one hole (63, 64) for each of said bottom plates (50), so that a plurality of hollow regions for receiving cosmetic products are defined into the supporting plate, and wherein the frame comprises arc-shaped wall elements (65) which are arranged on the internal side of top face (62), around the holes (63, 64), and which comprise a small tooth (66), facing the respective hole and adapted to be engaged by bottom plates (50).

* * * * *